US005833514A

United States Patent [19]

Eaton

[11] Patent Number: 5,833,514

[45] Date of Patent: Nov. 10, 1998

[54] REACTIONARY FORCE UTILIZATION

[76] Inventor: James O. Eaton, 22 Plantation Dr. NE., Cartersville, Ga. 30120

[21] Appl. No.: 368,488

[22] Filed: Jan. 4, 1995

[51] Int. Cl.[6] ..... A63H 17/26; A63H 29/22; A63H 23/04

[52] U.S. Cl. ..... 446/462; 446/456; 446/466; 446/163

[58] Field of Search ..... 446/443, 456, 446/462, 466, 460, 163

[56] References Cited

U.S. PATENT DOCUMENTS

| | | | |
|---|---|---|---|
| 2,923,092 | 2/1960 | Reiser | 446/460 X |
| 4,200,287 | 4/1980 | Ryan et al. | 446/460 X |
| 4,758,037 | 7/1988 | Suzuki et al. | 296/15 |
| 4,925,236 | 5/1990 | Hoh et al. | 296/180.5 |
| 5,061,007 | 10/1991 | Simpson | 296/180.5 |
| 5,106,147 | 4/1992 | Okada et al. | 296/180.1 |
| 5,141,281 | 8/1992 | Eger et al. | 296/180.5 |
| 5,165,751 | 11/1992 | Matsumoto et al. | 296/180.5 |

OTHER PUBLICATIONS

Steve Smith, Stock Car Chassis Technology, 1983 Steve Smith Autosports—Ch. 7 Rear Suspension pp. 69–90.

RC 10 Graphite Instruction Manual—AE Team Associated—1989 Associated Electrics, Inc.—pp. 1–40.

Brian Kinwald—"The Fastest Motor I've Ever Run"—Trinity–Advertisement.

*Primary Examiner*—Mickey Yu

[57] ABSTRACT

Rotational reactionary forces associated with drive trains which propel vehicles are harnessed and employed to move vehicle sub-components. The motor of a motor driven vehicle is mounted to the frame of the vehicle. The motor includes an output shaft that extends from the motor. The motor functions to rotate the output shaft, which rotation propels the vehicle. The motor further includes a motor housing from which the output shaft extends. The motor housing is pivotally mounted to the frame of the vehicle so as to allow substantial rotation of the motor housing with respect to the frame. The motor housing pivots in response to reactionary forces associated with the rotation of the output shaft. The motor housing interacts with sub-components of the vehicle such that the pivoting of the motor housing imparts motion upon the sub-components, such as air spoilers, suspension members, or trim adjustment devices.

7 Claims, 20 Drawing Sheets

REACTIONARY FORCE UTILIZATION

BACKGROUND OF THE INVENTION

The present invention relates generally to the field of vehicles and more particularly to the field of motor driven vehicles.

The motive force for propelling a vehicle is often provided by a drive train, or more particularly by a motor that is a part of the drive train. Motors such as, but not limited to, gasoline engines, diesel engines, and alternating or direct-current electric motors are conventionally employed to propel vehicles. Such motors convert energy into rotational mechanical motion. That rotational mechanical motion interacts, often by way of other drive train components such as, but not limited to, shafts, gear trains, differentials, or the like, with the environment exterior to the vehicle to propel the vehicle. In response to rotational mechanical motion of a motor or other drive train components, there are reactionary forces. The components or housings of a vehicle that are subjected to the reactionary forces are typically mounted to the vehicle such that they do not move substantially in response to reactionary forces.

Many vehicles are equipped with a wide range of movable sub-components or accessories such as, but not limited to, air spoilers or suspension assemblies in automotive vehicles, and trim adjustment devices in boats. The motive force for moving such movable sub-components is typically provided by a secondary motor which is separate from the motor (or motors) that provide the primary means for propelling the vehicle. For certain vehicles such as, but not limited to radio, controlled vehicles, it can be cost prohibitive to incorporate such secondary motors. This cost prohibitiveness has a tendency to minimize the number of actively movable sub-components in vehicles.

SUMMARY OF THE INVENTION

Briefly described, the present invention provides a method and apparatus for harnessing and employing reactionary forces that are associated with motor driven vehicles. More particularly, the preferred embodiments of the present invention provide methods and apparatus for harnessing and employing reactionary forces associated with drive train components such as, but not limited to, motors that propel vehicles. The harnessed reactionary forces are preferably employed to position sub-components relative to the vehicle.

In accordance with the first and second preferred embodiments of the present invention, a motor driven automobile is provided. The motor of the vehicle is mounted to the frame of the vehicle and an output shaft extends from the motor. The motor functions to rotate the output shaft, which rotation propels the vehicle. As is conventional, reactionary forces are developed that have a tendency to rotate the motor housing. The motor housing is pivotally mounted to the frame of the vehicle so as to allow substantial rotation of the motor housing with respect to the frame. Therefore, the motor housing tends to pivot in response to the reactionary forces. The motor housing interacts with sub-components of the vehicle such that the pivoting of the motor housing imparts motion upon the sub-components. Preferably a spoiler linkage assembly links the motor housing to and imparts motion upon an air spoiler, and a suspension linkage assembly links the motor housing to and imparts motion upon suspension components of the vehicle in a manner that seeks to enhance vehicle performance. In accordance with the first preferred embodiment of the present invention, the suspension linkage assembly includes a traction bar that pivots with the motor housing and applies force to opposed rear suspension arms of the vehicle.

In accordance with the second preferred embodiment of the present invention, the suspension linkage assembly includes a traction bar assembly that, in addition to pivoting with the motor housing, is capable of pivoting relative to the motor housing. The additional pivoting of the traction bar assembly with respect to the motor housing seeks to promote independent action of the opposed rear suspension arms. The traction bar assembly of the second preferred embodiment includes further features that also seek to further enhance vehicle performance.

In accordance with the first and second embodiments, the elongated motor axis extends between the opposite ends of the motor housing. The output shaft of the motor rotates about the elongated motor axis. Journals protruded from the opposite ends of the motor housing and extend generally in the axial direction. A first journal of the journals is received by a first bearing assembly associated with a first rigidly mounted motor mount. A second journal of the journals is received by a second bearing assembly associated with a second rigidly mounted motor mount. The journals cooperate with the bearing assemblies such that, in addition to the rotation of the output shaft about the elongated motor axis relative to the motor mounts, the motor housing rotates about the elongated motor axis relative to both the motor mounts and the output shaft.

In accordance with a first alternate embodiment of the present invention, an alternate motor is employed. The alternate motor is mounted to one of the motor mounts of the vehicle by way of a ball bearing assembly which is incorporated into the motor. The ball bearing assembly allows for rotation of both the motor housing and the output shaft in the manner discussed above. The motor housing of the alternate motor preferably includes an annular inner wall which defines an elongated cylindrical cavity within the motor housing. At one end of the motor housing, the cavity is occluded by a plate assembly. The plate assembly is disposed within the cavity and defines an annular periphery that faces the annular inner wall of the motor housing. A plurality of balls are interposed between the periphery of the plate assembly and the annular inner wall of the motor housing such that the motor housing and output shaft are capable of rotating relative to each other and relative to the motor mount.

In accordance with a second alternate embodiment of the present invention, a motor driven boat is provided. The motor of the boat is mounted to the hull of the boat and an output shaft extends from the motor. The motor functions to rotate the output shaft, which rotation propels the boat. The motor housing is pivotally mounted to the hull of the boat in the same general manner as discussed with respect to the first and second preferred embodiments. Therefore, the motor housing tends to pivot as a result of reactionary forces. The motor housing is linked to pivotally mounted sub-components such as, but not limited to, an air spoiler and a trim adjustment device. Thus, the movement of the motor housing is transferred to the sub-components.

In accordance with the aforementioned embodiments of the present invention, the motor housing preferably rotates to a degree that is sufficient to move sub-components; however, the motor preferably does not pivot through a plurality of revolutions. In accordance with a third alternate embodiment of the present invention, the motor housing pivots through a plurality of revolutions. In accordance with the third alternate embodiment, the rotation of the motor housing is preferably limited by a coil spring that encircles the elongated axis of the motor housing. A first end of the coil spring is preferably connected to the motor housing while a second end of the coil spring is preferably connected to the frame of the vehicle, or the like.

It is therefore an object of the present invention to provide a method and apparatus for utilizing reactionary forces.

Another object of the present invention is to minimize the number of motors required for operating vehicle sub-components.

Yet another object of the present invention is to provide an improved motor.

Still another object of the present invention is to provide for automatic adjustment to vehicle sub-components.

Still another object of the present invention is to provide vehicle sub-components that are responsive to variations in the output torque of the motor that propels a motorized vehicle.

Still another object of the present invention is to provide a system that interacts with the motor and suspension of a motorized vehicle in a manner that provides responsive traction control.

Still another object of the present invention is to provide a system that interacts with the motor and spoiler of a motorized vehicle in a manner that provides responsive control over the aerodynamics of the vehicle.

Still another object of the present invention is to provide a system that interacts with the motor and trim adjustments assemblies of a motorized vehicle in a manner that provides responsive trim control.

Other objects, features and advantages of the present invention will become apparent upon reading and understanding this specification, taken in conjunction with the accompanying drawings.

DETAILED DESCRIPTION OF THE PREFERRED EMBODIMENTS

Figure 1:
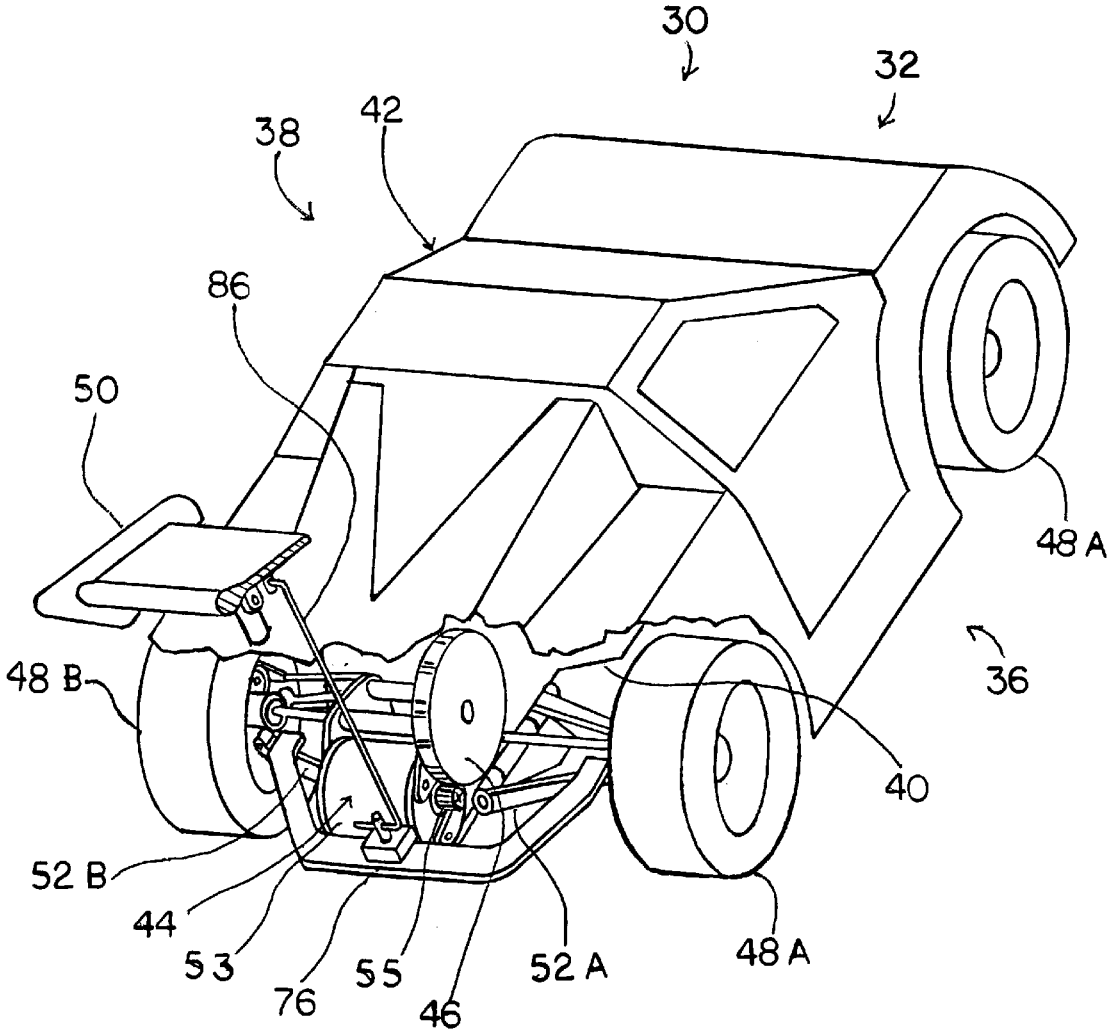
FIG. 1 is a partially cut-away, rear perspective view of an automotive vehicle, in accordance with a first preferred embodiment of the present invention.

Referring now in greater detail to the drawings, in which like numerals represent like components throughout the several views, FIG. 1 is a partially cut-away, rear perspective view of an automotive vehicle 30, in accordance with a first preferred embodiment of the present invention. The vehicle 30 includes a front 32, a rear 34, a right side 36, and a left side 38. The vehicle 30 further includes a conventional frame 40 which is generally covered by a conventional body 42. Wheels 48*a–d* are connected to the frame 40 in a conventional manner. Wheel 48*d*, which is not seen, is situated on the left side 38 toward the front 32 of the vehicle 30. Portions of the body 42 are cut-away at the rear 34 to expose a drive train 46 which includes a motor 44. In accordance with the first preferred embodiment of the present invention, the drive train 46, or more particularly the motor 44, is central to the inventive aspects of present invention. As discussed in greater detail below, the motor 44 preferably turns the wheels 48*a,b* by virtue of the fact that an output shaft 51 (FIGS. 7 and 8) of the motor 44 turns an output gear 55. As is also further discussed below, a motor housing 53 portion of the motor 44 inventively pivots and is linked to sub-components such as, but not limited to, an air spoiler 50 and suspension arms 52*a,b* such that the sub-components pivot in response to the pivoting of the motor housing 53. A spoiler linkage assembly 86 links the motor housing 53 to the air spoiler 50. The air spoiler 50 is shown partially cut-away if FIG. 1. A suspension linkage assembly 76 links the suspension arms 52*a,b* to the motor housing 53. The suspension arms 52*a,b* extend laterally from the frame 40 to support the wheels 48*a,b* respectively.

Figure 2:
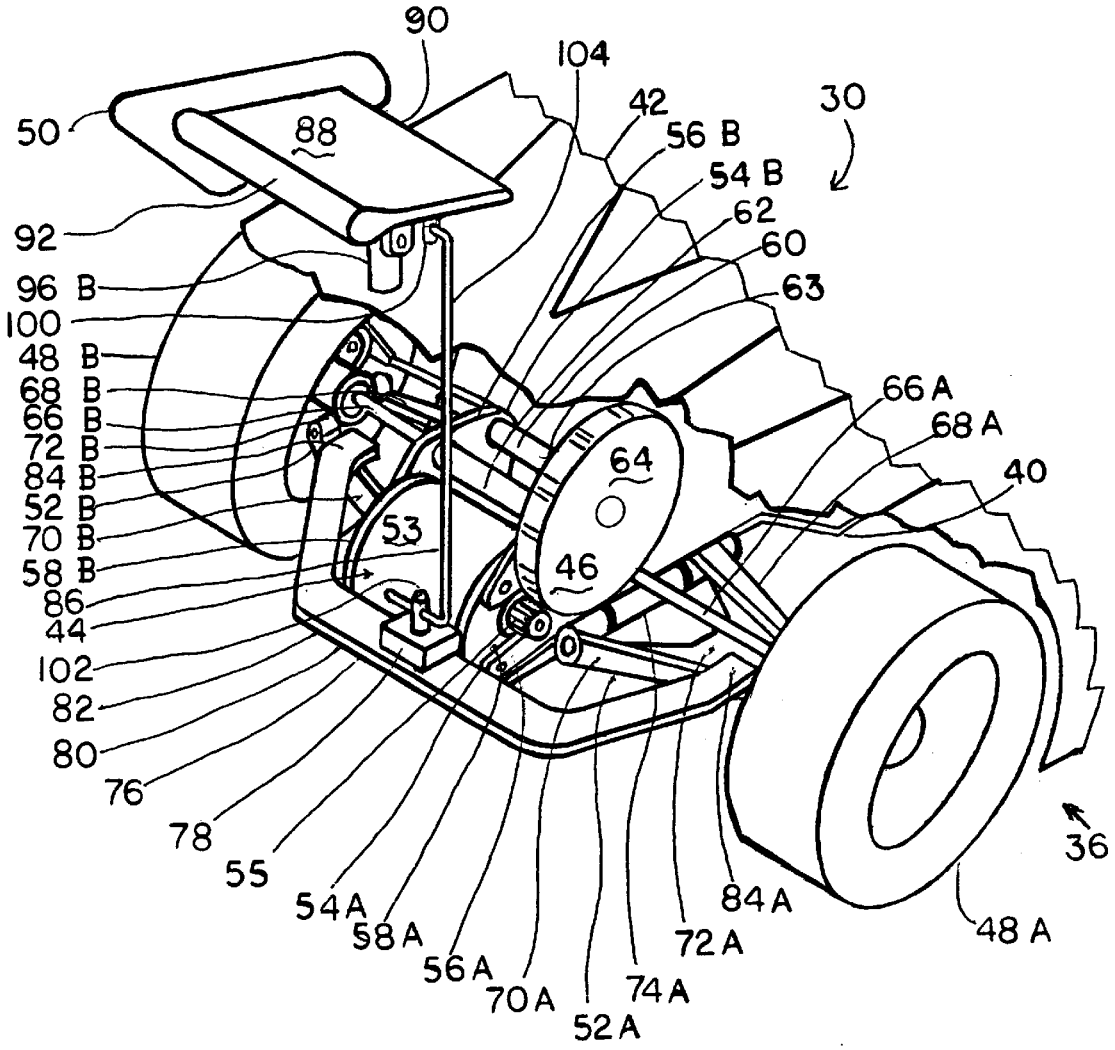
FIG. 2 is another partially cut-away, rear perspective view of the automotive vehicle of FIG. 1.

FIG. 2 is another partially cut-away, rear perspective view of the automotive vehicle 30, in accordance with the first preferred embodiment, wherein the front 32 (FIG. 1) of the vehicle 30, rear portions of the body 42, and a portion of the air spoiler 50 are cut-away. As discussed above, the motor 44 includes the outer motor housing 53 and the output shaft 51 (FIGS. 7 and 8) to which the output gear 55 is attached. In accordance with the preferred embodiment of the present invention, the motor 44 is preferably a direct-current type of electric motor, whereby the output shaft 51 is an armature shaft (see FIG. 10 for an exemplary armature shaft 176). In accordance with alternate embodiments of the present invention, the motor 44 is, for example and not limitation, acceptably a gasoline engine, diesel engine, alternating-current electric motor, or the like. Opposite ends of the motor housing 53 are pivotally mounted to the frame 40 by a pair of motor mounts 54*a,b*. The motor mounts 54*a,b* include mounting plates 56*a,b*, respectively, that are rigidly connected to the frame 40. The motor mounts 54*a,b* further include bearing plates 58*a,b,* respectively, that are rigidly connected to the mounting plates 56*a,b,* respectively. As discussed in greater detail below, the bearing plates 58*a,b* cooperate with the opposite ends of the motor housing 53 to pivotally mount the motor housing 53 to the frame 40. The mounting plates 56*a,b* are interconnected by interconnection members 60,62, as discussed in greater detail below. The drive train 46 further includes a conventional transmission assembly 63 that is disposed between the mounting plates 56*a,b*. The transmission assembly 63 is just forward of the motor 44 and is partially hidden behind the mounting plate 56*a* in FIGS. 1 and 2. Also included in the drive train 46 is a drive gear 64 that is extended from the transmission assembly 63 and meshes with the output gear 55. The drive train 46 further includes axles 66*a,b* that extend from opposite sides of the transmission assembly 63 to the wheels 48*a,b*, respectively. Rotation of the output gear 55 causes rotation of the drive gear 64, which, in conjunction with the transmission assembly 63, causes the axles 66*a,b* to rotate the wheels 48*a,b,* respectively, in a conventional manner. The wheels 48*a,b* are connected to the frame in a conventional manner by suspension arms 52*a,b,* respectively. Each suspension arm 52*a,b* includes elongated members 68,70 that span between a wheel 48 and the frame 40, and an web 72 extending between the elongated members 68,70. One end of each suspension arm 52*a,b* is pivotally connected to the frame 40 by a bushing assembly 74 (only one of which is seen in the figures herewith) in a conventional manner. The opposite end of the suspension arms 52*a,b* is connected to one of the wheels 48*a,b*, respectively, in a conventional manner. In accordance with the preferred embodiment of the present invention, the pivoting of the suspension arms 52*a,b* relative to the frame 40 is at least partially controlled and dampened by shock absorber and spring assemblies (not shown) in a conventional manner, as should be understood by those reasonably skilled in the art.

As mentioned previously, in accordance with the first preferred embodiment of the present invention, the motor housing 53 pivots with respect to the frame 40. The pivoting motion of the motor housing 53 is transferred by way of the suspension linkage assembly 76 to the suspension arms 52*a,b,* as discussed in greater detail below. The suspension linkage 76 assembly includes a link block 78 connected to the motor housing 53 and a traction assembly 80 connected to the link block 78. In accordance with the first preferred embodiment of the present invention, the traction assembly 80 is in the form of a traction bar 82 having opposite bar ends 84*a,b* which selectively apply force to the suspension arms 52*a,b,* respectively. The traction bar 82 is generally planar and rigid.

Figure 3:
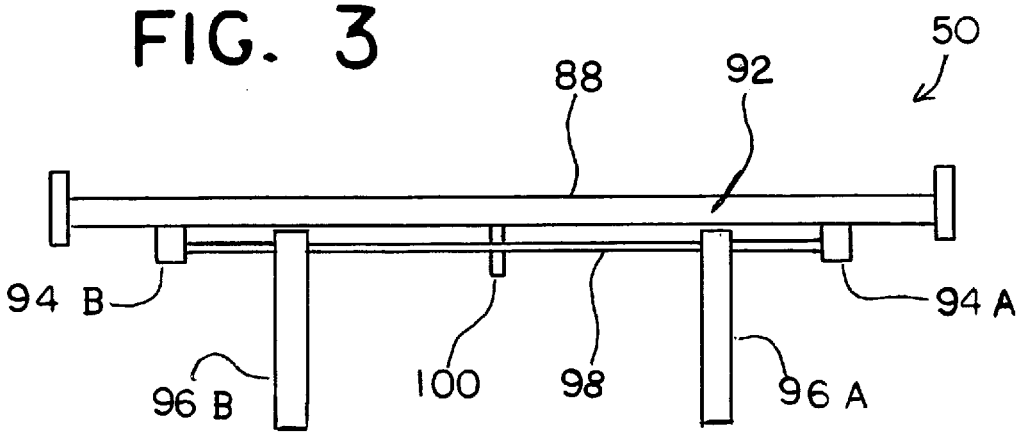
FIG. 3 is an isolated, rear elevational view of an air spoiler assembly of the automotive vehicle of FIG. 1, in accordance with the first preferred embodiment of the present invention.

As also mentioned previously, the pivoting motion of the motor housing 53 is additionally transferred by way of the spoiler linkage assembly 86 to a wing 88 portion of the air spoiler 50. Referring additionally to FIG. 3, which is an isolated rear view of the air spoiler 50 in accordance with the first preferred embodiment, the wing 88 of the air spoiler 50 includes a front edge 90 and a rear edge 92. Pivot posts 94*a,b* depend from the underside of the wing 88 proximate to opposite ends of the wing 88. Support posts 96*a,b* extend upward from the vehicle 30 to the wing 88. The lower ends of the support posts 96*a,b* are preferably rigidly connected to the vehicle 30. An elongated pivot rod 98 is connected at opposite ends thereof to the pivot posts 94*a,b* and extends through apertures defined through the upper ends of the support posts 96*a,b* in a manner that allows for the pivoting of the wing 88 relative to the support posts 96*a,b*. An upper link member 100 depends from the bottom of the wing 88 forward of the pivot rod 98. Referring back to FIG. 2, the spoiler linkage assembly 86 includes a lower link member 102 protruding upward from the link block 78. The spoiler linkage assembly 86 further includes a connecting rod 104 having opposite ends which are pivotally connected to the upper link member 100 and the lower link member 102, respectively.

Figure 4:
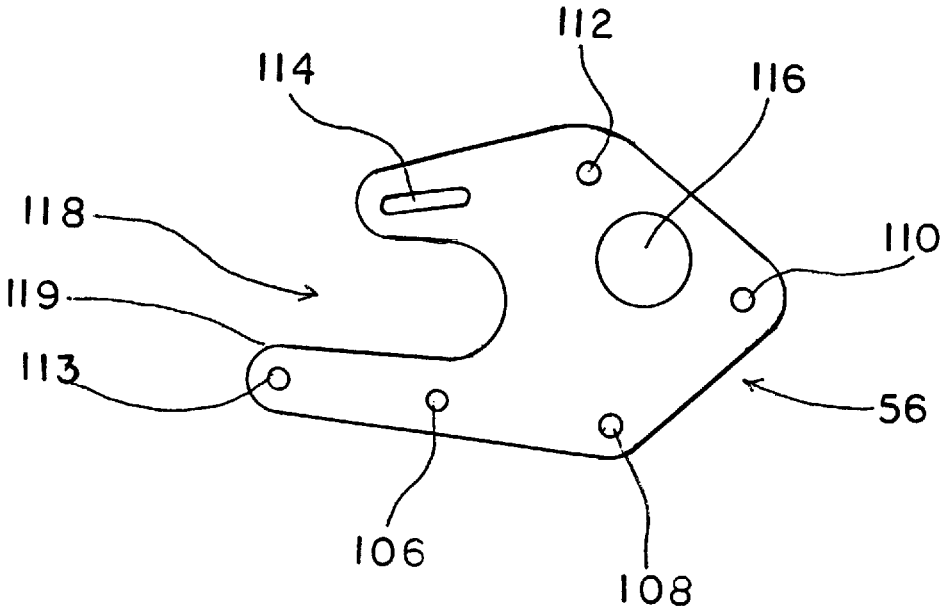
FIG. 4 is an isolated, side elevational view of a motor mounting plate of the automotive vehicle of FIG. 1, in accordance with the first preferred embodiment of the present invention.

FIG. 4 is a right side elevational view of one of the mounting plates 56*a,b* (FIG. 2), the side opposite being a mirror image. In accordance with the first preferred embodiment of the present invention, each of the mounting plates 56*a,b* is generally identical. Each mounting plate 56*a,b* is generally planar and thin, and defines connection holes 106, 108, 110, 112, 113, a connection slot 114, and a port 116 therethrough. Further, each mounting plate 56*a,b* defines a recess 118 that is oriented generally toward the rear 34 (FIG. 1) of the vehicle 30 (FIGS. 1 and 2), while the connection hole 110 is oriented generally toward the front 32 (FIG. 1) of the vehicle 30. Additionally, each mounting plate 56*a,b* defines a trailing edge 119.

Figure 6:
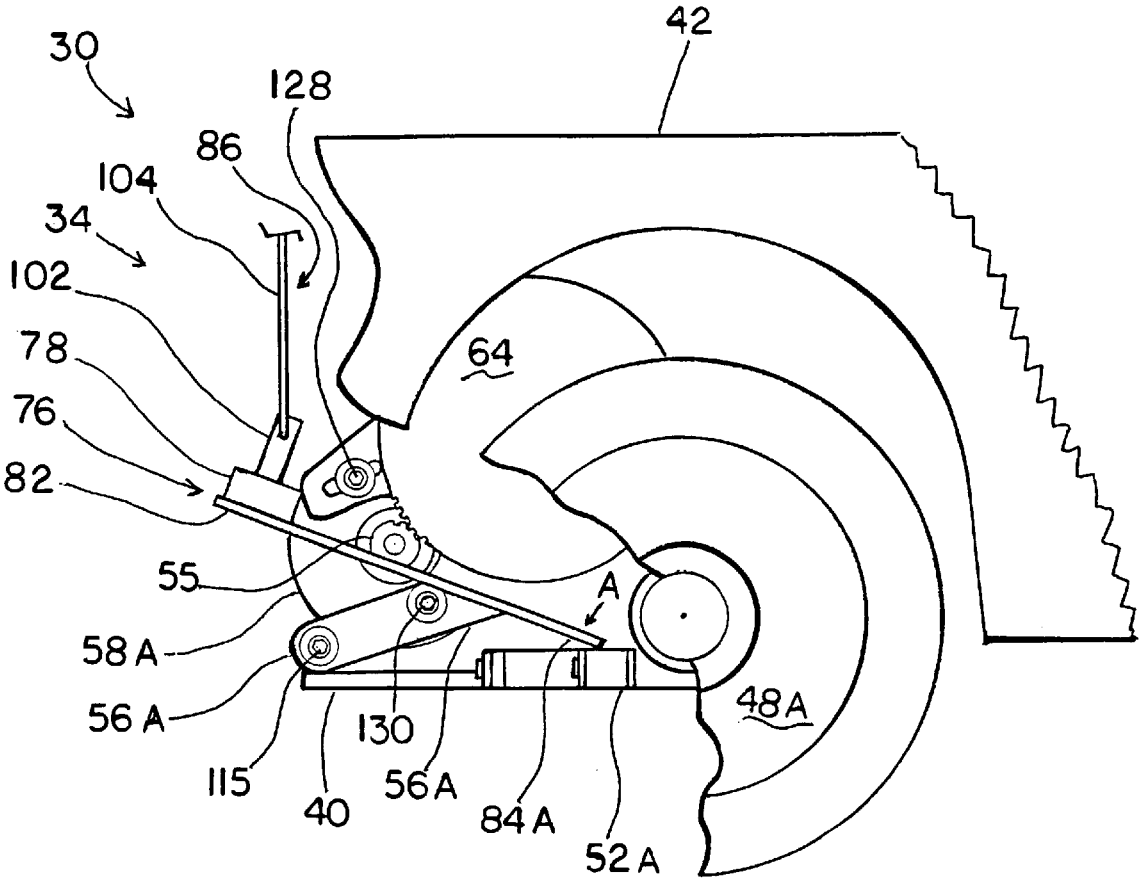
FIG. 6 is a partially cut-away, side view of a rear portion of the automotive vehicle of FIG. 1, in accordance with the first preferred embodiment of the present invention.

Referring to both FIGS. 2 and 4, mounting plate 56*a* is oriented toward the right side 36 (FIG. 2) of the vehicle 30. The left side of the mounting plate 56*a* abuts the right side of the transmission assembly 63 (FIG. 2). A plurality of threaded rods (not shown) extend from the right side of the transmission assembly 63, and one of the plurality of threaded rods extends into each of the connection holes 112, 110, 108 to stabilize the mounting plate 56*a* with respect to the transmission assembly 63. The terminuses of the threaded rods that extend into the connection holes 112, 110 are preferably flush with the right side surface of the mounting plate 56*a* so as not to interfere with the rotation of the drive gear 64 (FIG. 2). The terminus of the threaded rod that extends into the connection hole 108 actually extends from the right side of the mounting plate 56*a*, and a nut (not shown) is threaded onto that exposed terminus to rigidly secure the mounting plate 56*a* to the transmission assembly 63. Additionally, a horizontally extending rod (not shown) has a fist end connected at the connection hole 113 of mounting plate 56*a* and an opposite second end connected at the connection hole 113 of mounting plate 56*b*. A bolt 115 and associated washer that connects that horizontally extending rod (not shown) to the connection hole 113 of the mounting plate 56*a* is seen in FIG. 6. A similar bolt (not shown) is associated with the connection hole 113 of the mounting plate 56*b*.

Regarding the mounting plate 56*b*, the right ends of the interconnection members 60,62 (FIG. 2) are connected the left side of the transmission assembly 63 (FIG. 2). The left ends of the interconnection members 60,62 abut the right side of the mounting plate 56*b*. A threaded rod (not shown) protrudes from the left end of the interconnection member 60 and passes through the connection hole 110 of the mounting plate 56*b* where it is in receipt of a nut (not shown) such that the mounting plate 56*b* is rigidly connected to the transmission assembly 63. The left end of the interconnection member 62 is similarly connected to the connection hole 112 of the mounting plate 56*b* by way of a threaded rod and nut (neither of which is shown) such that the mounting plate 56*b* is further rigidly connected to the transmission assembly 63. An additional interconnection member (not shown) is similarly connected between the left side of the transmission assembly 63 and connection hole 108 of the mounting plate 56*b*.

Figure 5:
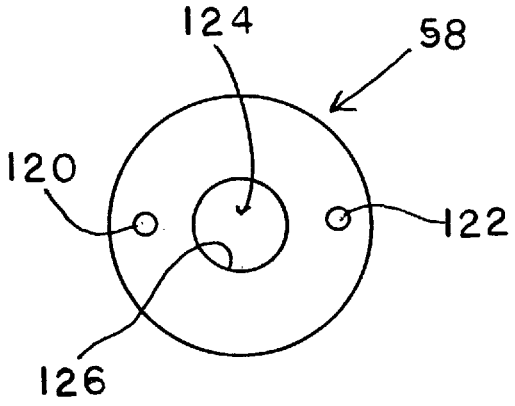
FIG. 5 is an isolated, side elevational view of a bearing plate of the automotive vehicle of FIG. 1, in accordance with the first preferred embodiment of the present invention.

FIG. 5 is a right side elevational view of one of the bearing plates 58*a,b* (FIG. 2), the side opposite being a mirror image. In accordance with the first preferred embodiment of the present invention, each of the bearing plates 58*a,b* is generally identical. Each of the bearing plates 58*a,b* is generally planar and thin. Each of the bearing plates 58*a,b* defines connection holes 120,122, and a rotation hole 124 therethrough. The bearing plates 58*a,b* each include a bearing surface 126 that encircles and defines the rotation hole 124.

Referring additionally to FIG. 6, which is an isolated, cut-away, right side, elevational view of the rear 34 of the vehicle 30, in accordance with the first preferred embodiment of the present invention, the right side of the bearing plate 58*a* abuts the left side of the mounting plate 56*a*. The connection holes 120,122 of the bearing plate 58*a* align with the connection slot 114 (FIG. 4) and connection hole 106 (FIG. 4), respectively, of the mounting plate 56*a*. Bolts 128,130, with associated washers, rigidly connect the bearing plate 58*a* to the mounting plate 56*a* such that the rotation hole 124 defined through the bearing plate 58*a* is aligned with the recess 118 defined through the mounting plate 56*a*. The head of the bolt 128 abuts a washer that abuts the right side of the mounting plate 56*a*, and the threaded rod of the bolt 128 extends through the connection slot 114 (FIG. 4) of the mounting plate 56*a* and threads into the connection hole 120 in the bearing plate 58*a*. The connection slot 114 accommodates selective manual forward and rearward adjustment of the motor 44, which adjustment assures proper meshing of the output gear 55 and the drive gear 64. The threaded rod of the bolt 128 preferably does not extend from the left side of the bearing plate 58*a*. The bolt 130 similarly connects the bearing plate 58*a* to the mounting plate 56*a* by way of the connection hole 106 (FIG. 4) of mounting plate 56*a* and the connection hole 122 of the bearing plate 58*a*. The bearing plate 58*b* is similarly rigidly connected to the right side of the mounting plate 56*b* by way of a pair of bolts (not shown) interacting with the connection holes 120,122 of the bearing plate 58*b* and the connection slot 114 and the connection hole 106 of the mounting plate 56*b*.

Figure 7:
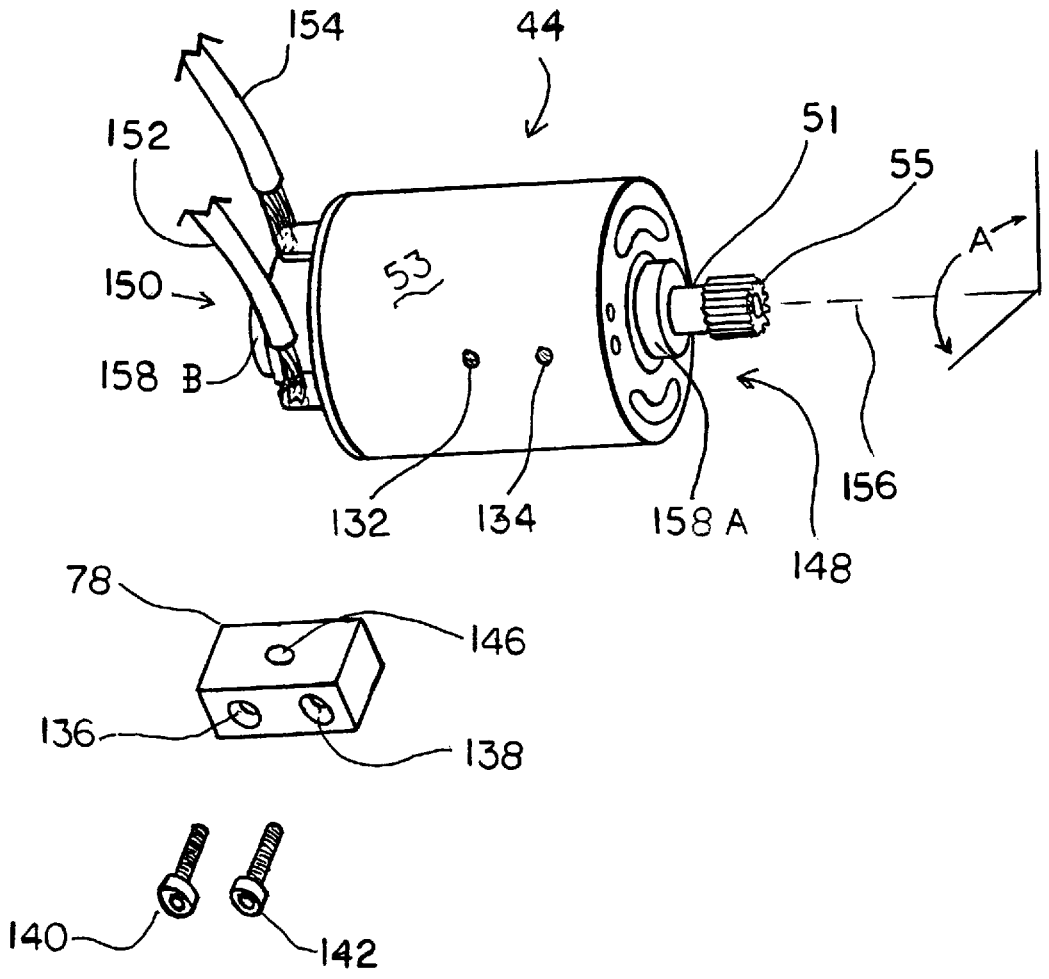
FIG. 7 is an isolated, partially exploded, perspective view of a motor and associated components of the automotive vehicle of FIG. 1, in accordance with the first preferred embodiment of the present invention.

FIG. 7 is an isolated, rear perspective view of the motor 44 with the link block 78 exploded therefrom, in accordance with the first preferred embodiment of the present invention. The motor housing 53 defines two connection holes 132, 134, and the link block 78 defines two connection passages 136, 138 therethrough. The threaded rods of bolts 140, 142 extend through the connection passages 136, 138, respectively, and thread into the connection holes 132,134, respectively to rigidly secure the link block 78 to the motor housing 53. The lower link member 102 (FIGS. 2, 6 and 9) fits into a bore 146 in the top of the link block 78, and the top of the traction bar 82 (FIGS. 2, 6 and 9) is rigidly affixed to the bottom of the link block 78. The motor 44 includes a right end 148 and a left end 150. The output shaft 51 (e.g. an armature shaft in accordance with the first preferred embodiment) protrudes from the motor housing 53 at the right end 150. The output gear 55 fits over the terminus of the output shaft 51 and is secured thereto by a set screw (not shown). A pair of electrical wires 152,154 are connected to the left end 150 of the motor 44 and extend to a battery assembly (not shown) that selectively and controllably supplies electricity to the motor 44. The supply of electricity causes the output shaft 51, and thereby the output gear 55, to rotate about the engine axis 156. An annular cylinder in the form of a journal, which is a journal sleeve 158*a* in accordance with the first preferred embodiment, protrudes from the motor housing 53 at the right end 148. Similarly, an annular cylinder in the form of a journal, which is a journal sleeve 158*b* in accordance with the first preferred embodiment, protrudes from the motor housing 53 at the left end 150.

Figure 8:
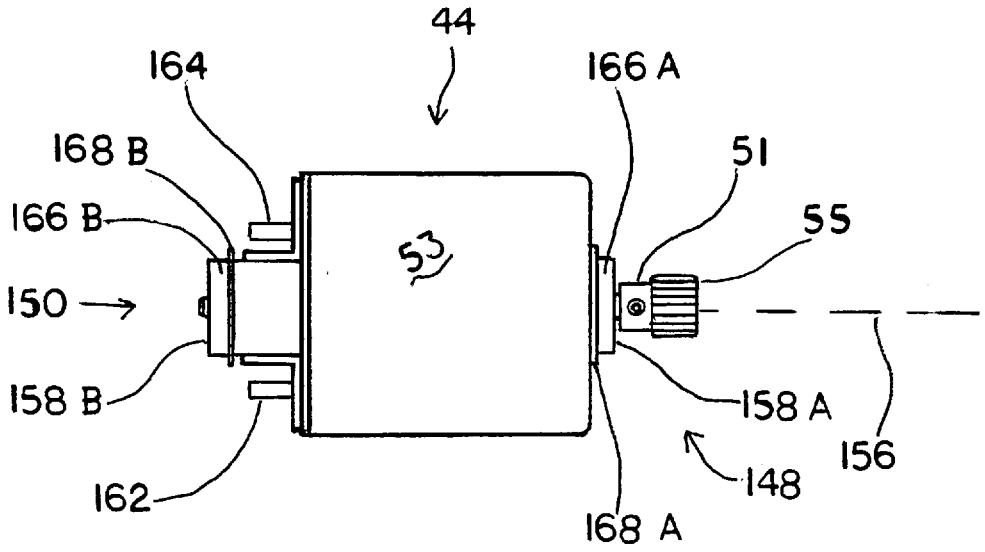
FIG. 8 is an isolated, top, plan view of the motor of FIG. 7.

FIG. 8 is an isolated, top plan view of the motor 44. Electrical leads 162, 164 extend from the left end 150 and receive the electrical wires 152, 154 (FIG. 7), respectively. The journal sleeve 158*a* includes an annular peripheral surface 166*a* and an annular, radially extending lip 168*a*. In accordance with the first preferred embodiment of the present invention, the peripheral surface 166*a* of journal sleeve 158*a* resides within the rotation hole 124 (FIG. 5) of the bearing plate 58*a* (FIGS. 2, 5 and 9) such that the peripheral surface 166*a* and the lip 168*a* of the journal sleeve 158*a* slidingly cooperate with the bearing surface 126 (FIG. 5) and the left side surface, respectively, of the bearing plate 58*a*. Similarly, the journal sleeve 158*b* includes an annular peripheral surface 166*b* and an annular, radially extending lip 168*b*. The peripheral surface 166*b* of the journal sleeve 158*b* resides within the rotation hole 124 (FIG. 5) of the bearing plate 58*b* (FIG. 2) such that the peripheral surface 166*b* and the lip 168*b* of the journal sleeve 158*b* slidingly cooperate with the bearing surface 126 (FIG. 5) and the right side surface, respectively, of the bearing plate 58*b*. The interaction of the journal sleeves 158*a,b* with the bearing plates 58*a,b* (FIG. 2), respectively, allow for the selective pivoting of the housing 53 about the motor axis 156. That is, the journal sleeves 158*a,b* are capable of slidingly and pivotally interacting with the bearing plates 58*a,b*, respectively.

In accordance with the first preferred embodiment of the present invention, the vehicle 30 operates as follows. Referring back to FIG. 2, when the motor 44 operates, the output shaft 51 (FIGS. 7 and 8) turns in a counterclockwise direction (when viewed from the right side 36) such that the remainder of the drive train 46 causes the wheels 48*a,b* to turn so as to propel the vehicle 30 forward. A reactionary force is developed during motor 44 acceleration that seeks to cause the motor housing 53 to turn in a clockwise direction (when viewed from the right side 36). Due to the fact that the motor housing 53 is pivotally mounted at the opposite ends thereof, as discussed above, the motor housing 53 tends to pivot clockwise (when viewed from the right side 36) during motor acceleration in response to the aforementioned acceleration related reactionary force. Reactionary forces also exist during times of motor 44 deceleration that tend to pivot the motor housing 53 counterclockwise (when viewed from the right side 36).

Referring to FIG. 7, in accordance with the first preferred embodiment of the present invention, the motor housing 53 pivots through an angle "a" about the motor axis 156. This pivoting occurs while the motor housing 53 is mounted, in the manner discussed above, to the motor mounts 54*a,b* (FIG. 2) due to the aforementioned reactionary forces. In accordance with the first preferred embodiment of the present invention, the angle "a" is approximately 40 degrees, while in other embodiments of the present invention the angle "a" is greater than and less than 40 degrees.

More specifically, and with reference to FIGS. 2 and 6, in accordance with the first preferred embodiment of the present invention, during times of motor 44 acceleration, the motor housing 53 tends to pivot clockwise (when viewed from the right side 36) such that the suspension linkage assembly 76 causes the traction bar 82 to pivot clockwise (when viewed from the right side 36) such that the bar ends 84*a,b* thereof contact and force the suspension arms 52*a,b*, respectively, downward in a manner that tends to increase wheel 48 traction; as is represented by arrow "A" in FIG. 6. In accordance with the first preferred embodiment of the present invention, the downward force is generated even if the tires 48*a,b* do not have traction with respect to the surface they are intended to be contacting. Additionally, during times of motor 44 acceleration, the clockwise pivoting of the motor housing 53 causes the spoiler linkage assembly 86 to pivot the wing 88 counterclockwise (when viewed from the right side 36) such that the wing 88 tends to be generally horizontal during periods of acceleration to minimize wind resistance. The degree to which the wing 88 is capable of pivoting counterclockwise is limited by the distance to which the traction bar 82 is capable of pivoting the suspension arms 52*a,b* downward. In other words, the suspension arms 52*a,b* function as stops that the define the maximum distance to which the motor housing 53 is capable of rotating in the clockwise direction. In accordance with the first preferred embodiment of the present invention, clockwise rotation of the motor housing 53 is preferably limited solely by the suspension arms 52*a,b*.

Figure 9:
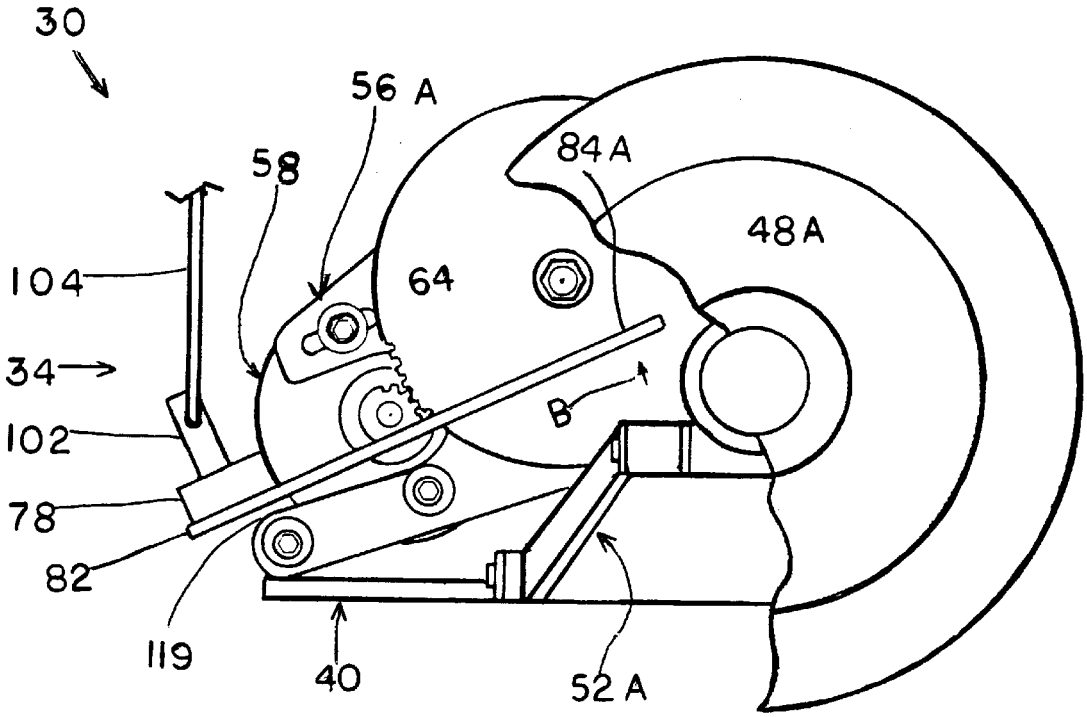
FIG. 9 is another partially cut-away, side view of a rear portion of the automotive vehicle of FIG. 1, in accordance with the first preferred embodiment of the present invention.

FIG. 9 is an isolated, cut-away, right side, elevational view of portions of the rear 34 of the vehicle 30, in accordance with the first preferred embodiment of the present invention. As discussed above, and with reference to both FIGS. 2 and 9, during times of motor 44 deceleration, the motor housing 53 tends to pivot counterclockwise (when viewed from the right side 36). In response to this counterclockwise pivoting, the suspension linkage assembly 76 causes the traction bar 82 to pivot counterclockwise (when viewed from the right side 36) such that the bar ends 84*a,b* thereof tend to move away from the suspension arms 52*a,b*, respectively, as is indicated by arrow "B" in FIG. 9. Also, as the traction bar 82 pivots counterclockwise, the underside of the traction bar 82 eventually abuts the trailing edges 119 (FIG. 4) of the mounting plates 56*a,b*, whereby the counterclockwise rotation of the motor housing 53 is limited. In accordance with the first preferred embodiment of the present invention, counterclockwise rotation of the motor housing 53 is preferably limited solely by the abutment of the underside of the traction bar 82 with the trailing edges 119. Additionally, during times of motor 44 deceleration, the counterclockwise pivoting of the motor housing 53 causes the spoiler linkage assembly 86 to pivot the wing 88 clockwise (when viewed from the right side 36) such that the wing 88 tends toward a more vertical configuration during motor 44 deceleration, whereby the wing 88 tends to slow the vehicle 30. The wing 88 is preferably pivoted clockwise such that the front edge 90 of the wing 88 is lower than the rear edge 92. Thus, as the vehicle 30 travels forward, air impinges upon the upper surface of the wing 88 such that the rear 34 of the vehicle 30 is forced downward in a manner that increases tire 48*a,b* traction.

In accordance with the first preferred embodiment of the present invention, the automotive vehicle 30 is acceptably, but not limited to, a reduced scale, radio controlled, electric car. The fact that the vehicle 30 is, in accordance with the first preferred embodiment, a reduced scale and radio controlled vehicle 30 is significant in that humans are preferably not transported therein. When humans are transported in a vehicle, the humans can typically sense the performance characteristics of the vehicle and adjust sub-components of the vehicle accordingly to maintain vehicle stability and predictability. As mentioned just above, in accordance with the first preferred embodiment of the present invention the vehicle 30 is a reduced scale vehicle; therefore, humans are preferably not transported in the vehicle 30. Thus, it is important that the vehicle 30 of the first preferred embodiment operates in a manner such that the vehicle 30 is automatically stable and predictable as a result of the inventive aspects of the present invention, as discussed in greater detail below.

The scale of the vehicle 30 is preferably approximately 1/10 or 1/12 of that of a vehicle that transports humans. An acceptable example of a reduced scale, radio controlled, electric car, which is capable of being modified to function as the automotive vehicle 30 of the first preferred embodiment, is an RC10 GRAPHITE car which is available from Associated Electrics, Inc. of Costa Mesa, Calif. The mounting plates 56*a,b* (FIGS. 2, 4, 6, and 9) are acceptably constructed from a generally rigid material such as, but not limited to aluminum or graphite. The bearing plates 58*a,b* (FIGS. 2, 5, 6, and 9) are also acceptably constructed from a generally rigid material such as, but not limited to, aluminum or graphite. Additionally, the journal sleeves 158*a,b* (FIGS. 7, 8, 11, and 12) are acceptably constructed from a generally rigid material such as, but not limited to aluminum.

Figure 10:
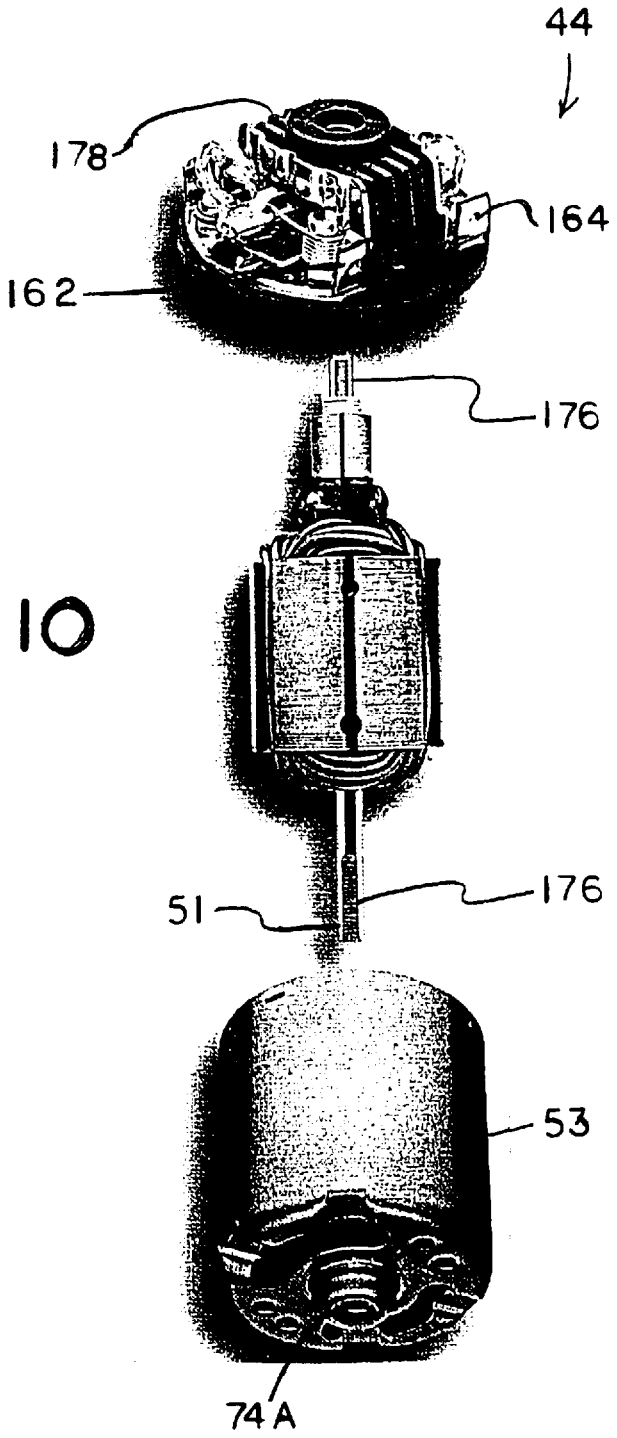
FIG. 10 Prior Art
FIG. 10 is an isolated, exploded, perspective view of a prior art motor.
Figure 11:
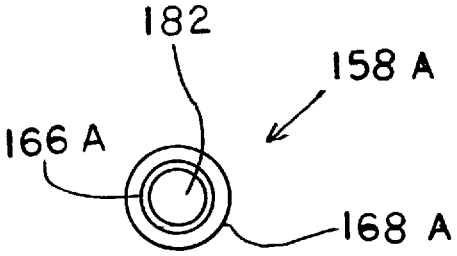
FIGS. 11 and 12 are isolated right side and rear elevational views, respectively, of a journal sleeve portion of the motor of FIG. 7, in accordance with the first preferred embodiment of the present invention.
Figure 12:
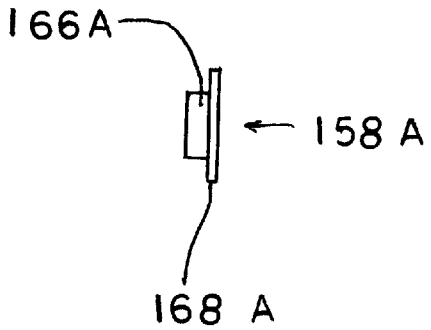

As mentioned previously, in accordance with the first preferred embodiment the motor 44 is acceptably a direct-current type electric motor. An acceptable example of an electric motor is an EXTECH motor available from TRINITY of Linden, N.J. FIG. 10 is a perspective, exploded view of an acceptable motor 44' prior to being modified such that it includes journal sleeves 158*a,b* (FIGS. 7, 8, 11, and 12). The motor 44' includes a motor housing 53' into which the connection holes 132,134 (FIG. 7) are bored. The motor 44' further includes bearing housings 174*a,b* (bearing housing 174*b* is not seen) that protrude from opposite ends of the motor 44'. The opposite ends of the armature shaft 176 extend into and through the bearing housings 174*a,b*, and the bearing housings 174*a,b* are constructed and arranged to provide for the pivoting of the armature shaft 176 with respect to the motor housing 53. While the bearing housing 174*a* is clearly seen, the bearing housing 174*b* is obscured within excess material 178 at one end of the motor 44'. In accordance with the first preferred embodiment of the present invention, the excess material 178 is at least partially cut-away to expose the bearing housing 174*b*. Then, the journal sleeves 158*a,b* are press-fit over the bearing housings 174*a,b*, respectively. FIGS. 11 and 12 are isolated right side 36 (FIG. 1) and rear 34 (FIG. 1) views, respectively the journal sleeve 158*a*, which is generally representative of journal sleeve 158*a* (FIGS. 7 and 8). The journal sleeve 158*a* defines an aperture 182 therethrough that is occupied by the bearing housing 174*a* (FIG. 10) subsequent to the press fitting of the journal sleeve 158*a* over the bearing housing 174*a*. The journal sleeve 158*a* includes the annular peripheral surface 166*a* and the annular lip 168*a*. In accordance with an alternate embodiment of the present invention, the journal sleeves, 158*a,b* are not employed. Rather, the bearing housings 174*a,b* (FIG. 10) are smoothed, for example by "turning them" on a lathe, and the resulting exterior annular surface of the bearing housings 174*a,b* are employed as journals with respect to the bearing plates 58*a,b* (FIGS. 2, 5, 6, and 9).

Figure 13:
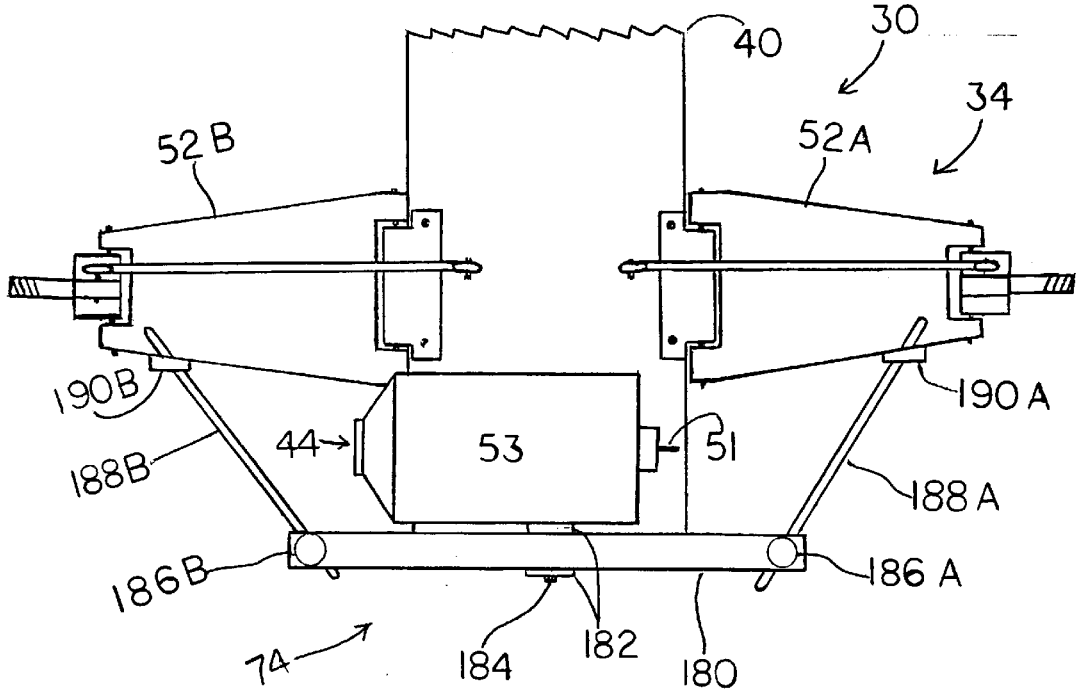
FIGS. 13 and 14 are top and rear views, respectively, of isolated and cut-away portions of the rear of an automotive vehicle, in accordance with a second preferred embodiment of the present invention.
Figure 14:
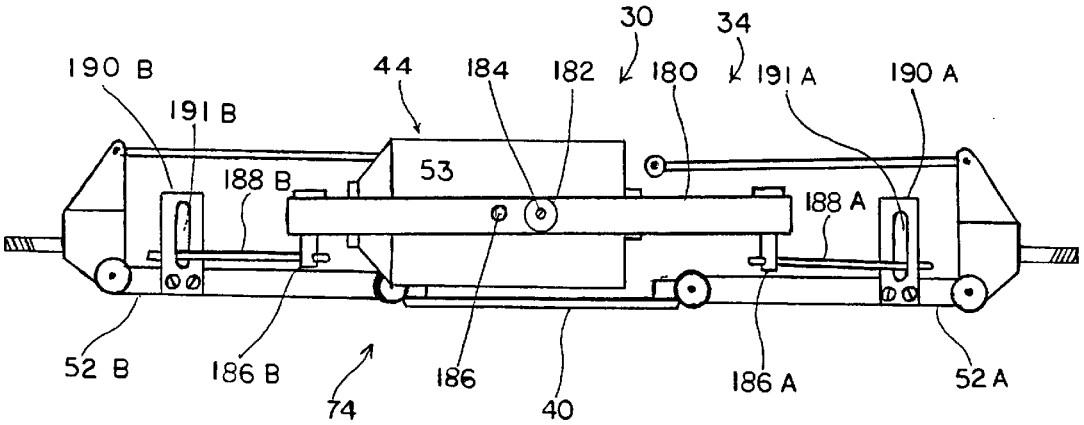

FIGS. 13 and 14 are rear and top views, respectively, of isolated and cut-away portions of the rear 34' of an automotive vehicle 30', in accordance with a second preferred embodiment of the present invention. With the exception of that which is noted, the automotive vehicle 30' of the second preferred embodiment is generally identical to the automotive vehicle 30 (FIGS. 1 and 2) of the first preferred embodiment. The automotive vehicle 30' of the second preferred embodiment includes a suspension linkage assembly 74' that includes a bar member 180 having a bushing 182 extending through a hole (not seen) defined through the bar member 180. A bolt 184 extends through the bushing 182 and threads into the connection hole 134 (FIG. 7) defined in the motor housing 53" of the motor 44" such that the bar member 180 is capable of pivoting about the elongated axis of the bolt 184. The bar member 180 defines another hole 186 therethrough. In accordance with alternate embodiments of the present invention, a supplemental bolt (not shown) is capable of being extended through the hole 186 and threaded into the connection hole 132 (FIG. 7) of the motor housing 53" to selectively preclude rotation of the bar member 180 about the bolt 184. Pivot pins 186*a,b* extend through holes defined through the bar member 180 proximate to the opposite ends thereof The pivot pins 186*a,b* are capable of pivoting about their elongated axes relative to the bar member 180. Rods 188*a,b* extend between the pivot pins 186*a,b*, respectively, and the suspension arms 52'*a,b*. The portions of the pivot pins 186*a,b* that depend from the bar member 180 defined holes therethrough. Ends of the rods 188*a,b* extend through the holes in the pivot pins 186*a,b*, respectively. Linkage plates 190*a,b* are attached to the suspension arms 52'*a,b*, respectively. The linkage plates 188*a,b* define apertures 191*a,b*, respectively, therethrough. The apertures 191*a,b* are in receipt of the ends of the rods 188*a,b*, respectively, which are distant from the pivot pins 186*a,b*.

The suspension linkage assembly 74' functions to transfer rotation of the motor housing 53" to the suspension arms 52'*a,b* in a manner similar to that in which the linkage assembly 74 (FIG. 2) of the first preferred embodiment functions. However, it is thought that the pivoting of the bar member 180 with respect to the motor housing 53" might enhance the performance of the vehicle 30 by maintaining the independence of the suspension arms 52'*a,b*. Further, performance characteristics are capable of being varied by decreasing the effective size of the apertures 191*a,b* defined through the linkage plates 190*a,b*. The effective size of the apertures 191*a,b* is capable of being varied, for example, by partially occluding the apertures 191*a,b* with bolts or the like. Additionally, in accordance with the second preferred embodiment of the present invention, the linkage plates 190*a,b* are capable of being manually repositioned along the length of the suspension arms 52'*a,b*, and this will vary the performance characteristics of the vehicle 30'. For example, and not limitation, the linkage plates 190*a,b* are shown variously positioned in FIGS. 15–17, which are rear views of isolated and cut-away portions of the rear 34' of the automotive vehicle 30', in accordance with the second preferred embodiment of the present invention.

Figure 15:
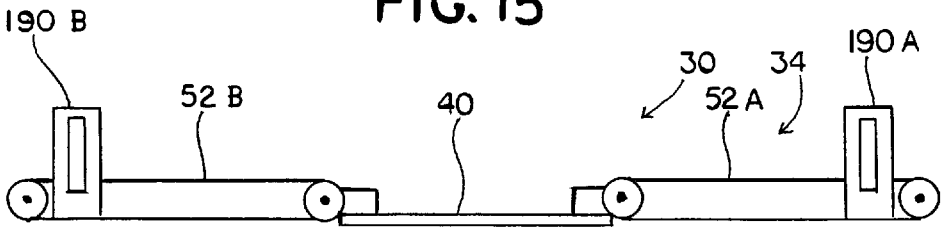
FIGS. 15–17 are rear elevational views of isolated and cut-away portions of that which is depicted in FIGS. 13 and 14, in varied configurations, in accordance with the second preferred embodiment of the present invention.
Figure 16:
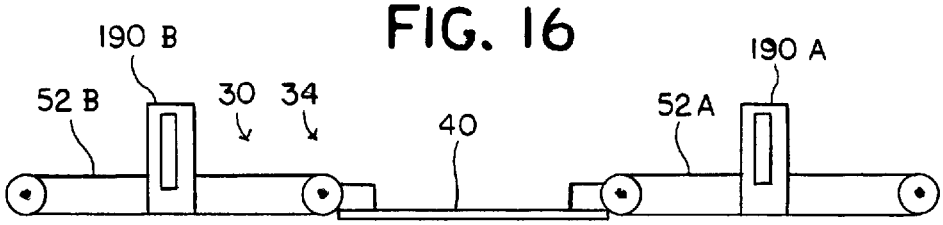
Figure 17:
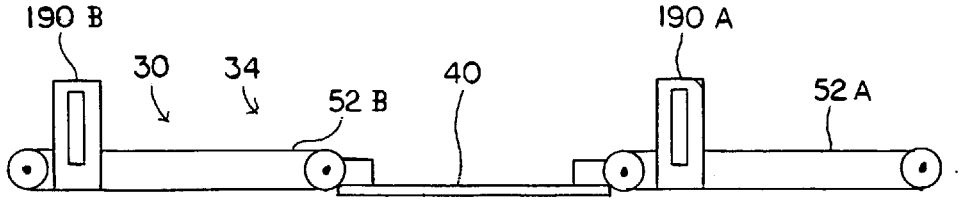
Figure 18:
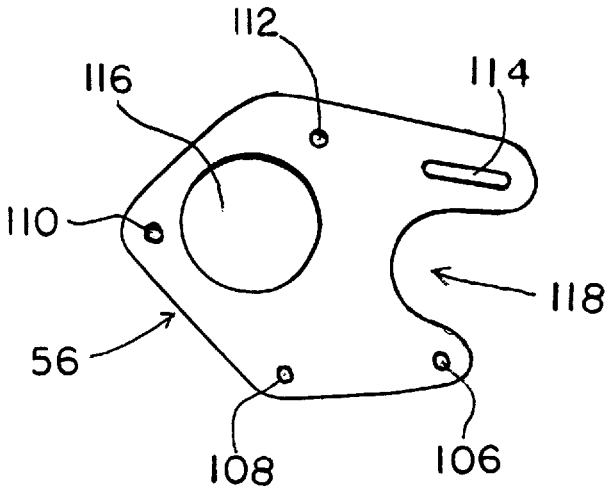
FIG. 18 is an isolated, side elevational view of a motor mounting plate in accordance with the second preferred embodiment of the present invention.

Referring back to FIGS. 13 and 14, the aforementioned pivoting of the pivot pins 186*a,b* accommodates for the various positioning of the linkage plates 190*a,b* (see FIGS. 15–17 for example). The linkage plates 190*a,b* function to limit the degree to which the motor housing 53" is capable of rotating about the motor axis by virtue of the fact that the travel of the ends of the rods 188*a,b* within the apertures 191*a,b* is limited by the linkage plates 190*a,b*. Thus, in accordance with the second preferred embodiment of the present invention, the mounting plates 56*a,b* (FIGS. 2, 4, 6, and 9) of the first preferred embodiment are preferably replaced with modified mounting plates 56'*a,b* (FIG. 18) that do not include trailing edges 119 (FIG. 4) for abutting the suspension linkage assembly 74' in a manner that limits rotation of the motor housing 53'". Additionally, the horizontally extending rod of the first preferred embodiment that extends between the connection holes 113 (FIG. 4) of the mounting plates 56*a,b* (FIGS. 2, 4, 6, and 9), respectively, is not included in the second preferred embodiment of the present invention. FIG. 18 is a right side elevational view of one of the modified mounting plates 56'*a,b*, the side opposite being a mirror image, in accordance with the second preferred embodiment of the present invention. The modified mounting plates 56*a,b* are preferably generally identical. Referring back to FIGS. 13 and 14, the automotive vehicle 30' of the second preferred embodiment, as well as the automotive vehicle 30 (FIGS. 1 and 2) of the first preferred embodiment, preferably include conventional elongated turnbuckle assemblies 192*a,b* that are capable of being manipulated to adjust the "tow-in" of the wheels 48*a,b* (FIGS. 1 and 2). Further, in accordance with the second preferred embodiment of the present invention the connection rod 140 (FIGS. 2 and 3) is connected to the bar member 180.

Figure 19:
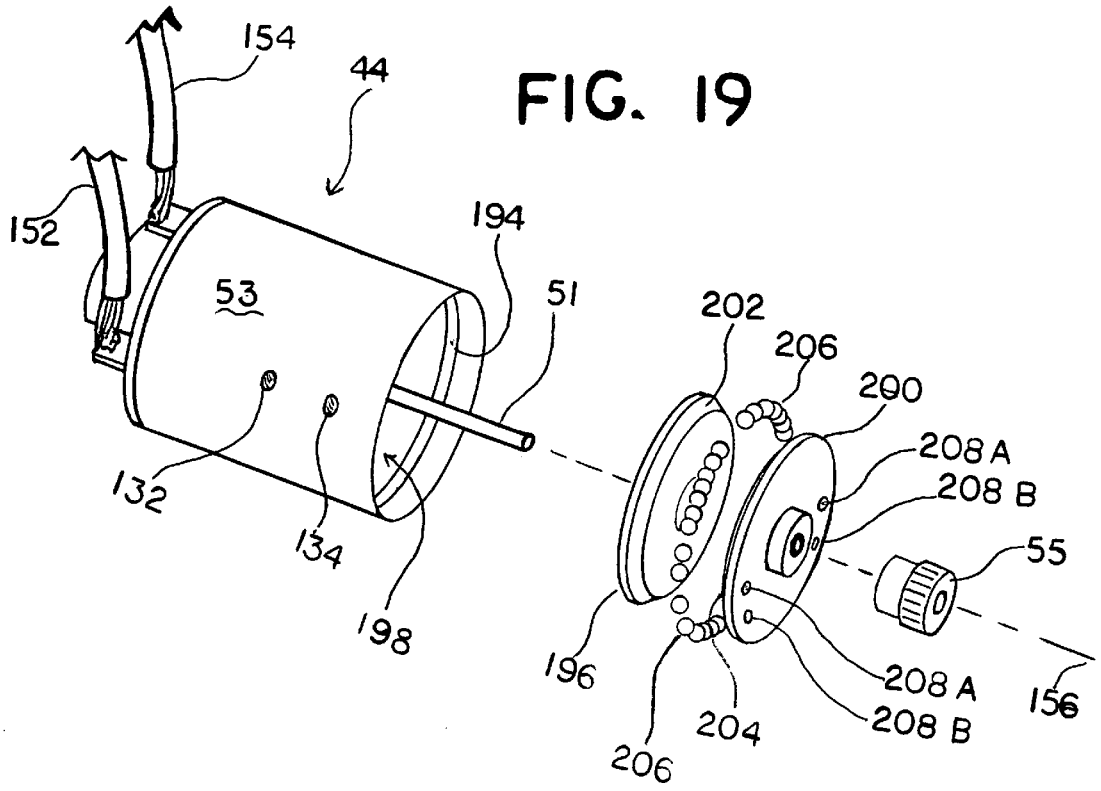
FIG. 19 is an isolated, partially exploded view of a motor in accordance with a first alternate embodiment of the present invention.

FIG. 19 is an isolated, perspective, partially exploded view of a motor 44'", in accordance with a first alternate embodiment of the present invention. The motor housing 53'" defines an annular channel 194 on the interior surface thereof The output shaft 51'" inserts through a central hole in a first bearing plate 196 which is inserted into the cavity 198 defined by the motor housing such that the periphery of the bearing plate 196 is proximate to the channel 194. Similarly, the output shaft 51'" inserts through a central hole in a second bearing plate 200 which is inserted into the cavity 198 after the first bearing plate 196 is inserted. At least one of the central holes in the bearing plates 196,200 is preferably equipped with a bearing assembly (not shown) which promotes the rotation of the output shaft 51'" with respect to the bearing plates 196,200. An annular groove 202 is defined at the periphery of the first bearing plate 196, and the annular groove 202 generally faces the second bearing plate 200. Similarly, an annular groove 204 is defined at the periphery of the second bearing plate 200, and the annular groove 204 generally faces the first bearing plate 196. A plurality of balls 206 are inserted between the bearing plates 196,200, and the bearing plates 196,200 are forced toward each other, for example by attaching and tightening a bolt (not shown) therebetween. As a result, the balls 206 are forced to occupy the annular channel 194 and annular grooves 202,204 such that the motor housing 53' is capable of pivoting about the motor axis 156'" relative to the bearing plates 196,200.

Referring additionally to FIG. 2, in accordance with the first alternate embodiment of the present invention, the vehicle 30 is slightly modified to allow for the incorporation of the motor 44'" thereinto. The motor mount 54*b* (which includes mounting plate 56*b* and bearing plate 58*b*, as discussed above) and the interconnection members 60,62 (plus the additional interconnection member and the other horizontally extending rod (associated with connection holes 113 (FIG. 4)) that are not shown, but which were discussed above) are not employed. Similarly, the bearing plate 58*a* of motor mount 54*a* is not employed. In accordance with the first alternate embodiment of the present invention, the second bearing plate 200 is directly and rigidly connected to the mounting plate 56*a*. Such mounting is acceptably facilitated, for example, by bolting the second bearing plate 200 to the mounting plate 56*a* by way of the connection hole 106 (FIG. 4) and connection slot 114 (FIG. 4) of the mounting plate 56*a* and an appropriate pair of the connection holes 208*a–b* defined in the second bearing plate 200. Once the motor 44" is so attached, it functions and interacts with various components of the automotive vehicle 30 in a manner similar to that discussed above, as should be understood by those reasonably skilled in the art upon fully reading and understanding this disclosure.

Figure 20:
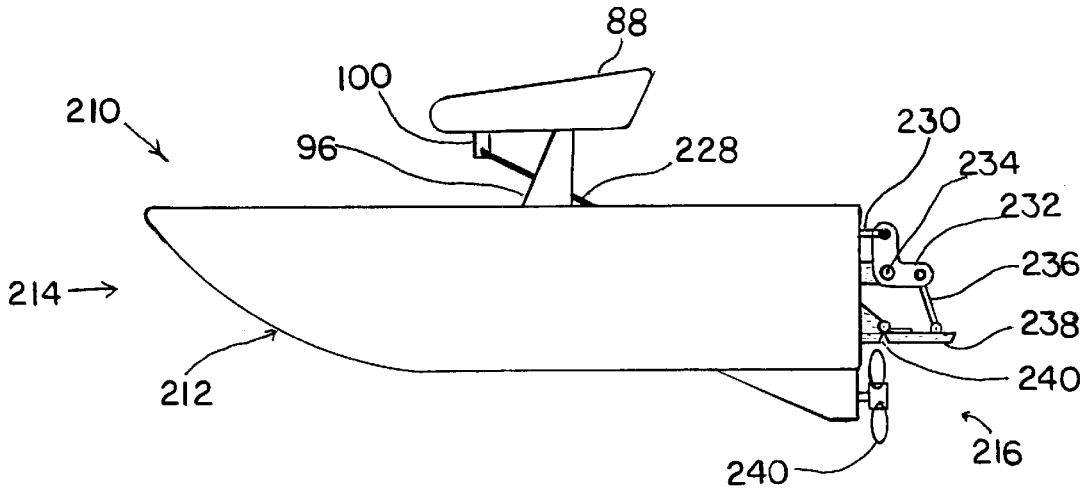
FIG. 20 is a side elevational view of a boat in accordance with a second alternate embodiment of the present invention.
Figure 21:
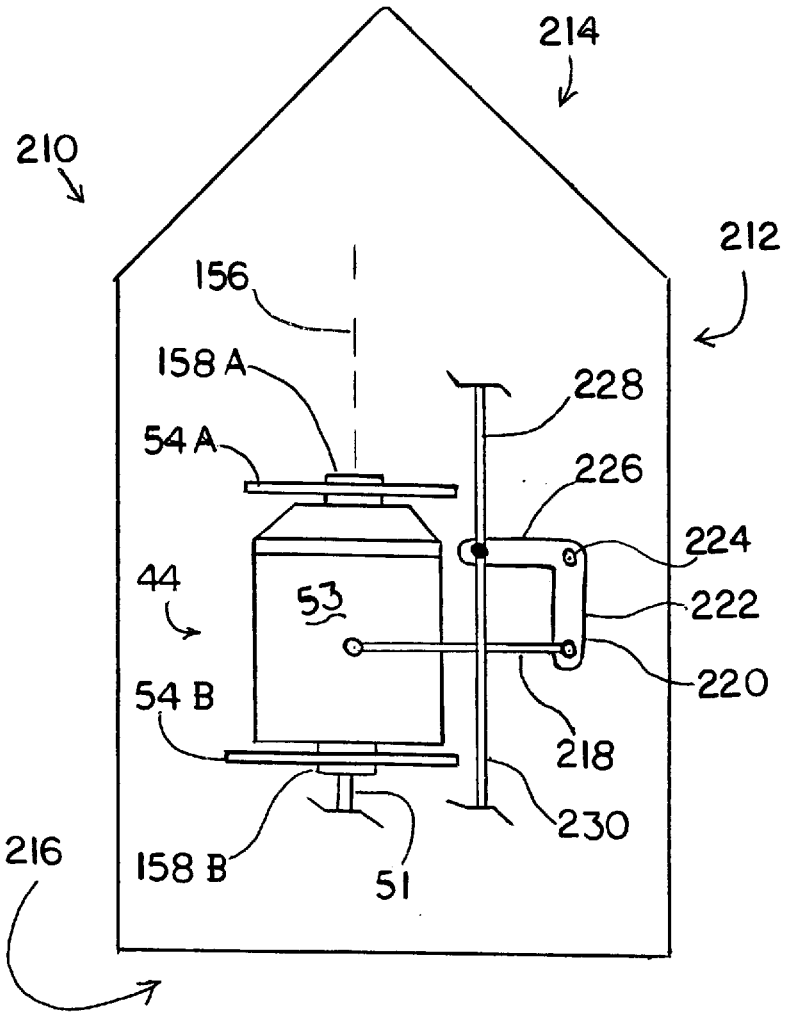
FIG. 21 is a schematic, cut-away, top view of the boat of FIG. 20, in accordance with the second alternate embodiment of the present invention.

FIG. 20 is a side view of a boat 210 in accordance with a second alternate embodiment of the present invention. FIG. 21 is a schematic, cut-away, top view of the boat 210, in accordance with the second alternate embodiment of the present invention. The boat 210 includes a frame in the form of a hull 212 having a front 214 and a rear 216. With reference to FIG. 21, journals 158""*a,b* at opposite ends of the motor 44"" cooperate with motor mounts 54""*a,b* such that the motor housing 53"" pivots about the motor axis 156"" in response to reactionary forces, as discussed above. A rod 218 is connected between the motor housing 53"" and an arm 220 of a pivot plate 222. The pivot plate 222 is mounted to a pivot pin 224 such that, under the influence of the rod 218, the pivot plate 222 pivots about the pivot pin 224 in response to rotation of the motor housing 53"" such that a second arm 226 of the pivot plate 222 is moved. With reference additionally to FIG. 21, a rod 228 is connected between the arm 226 and a wing 88' in a manner that causes the wing 88' to pivot relative to a support post 96' and the hull 212 in response the pivoting of the motor housing 53"". A rod 230 extends between the arm 226 of the pivot plate 222 and a first arm of a second pivot plate 232 which pivots about a pivot pin 234. A rod 236 is pivotally connected between a second arm of the second pivot plate 232 and a trim adjusting sub-component that is, in accordance with the second alternate embodiment, in the form of a trim plate 238. The trim plate 238 is pivotally connected at a forward edge 240 thereof to the hull 212.

The output shaft 51"" of the motor 44"" is linked to and drives a propeller 240 that functions to propel the boat 210. As the motor 44"" accelerates, the motor housing 53"" rotates in a first direction about the motor axis 156"", and the rods 218, 228, 230, 236 and pivot plates 222,232, transfer the motion of the motor housing 53"" to the wing 88' and trim plate 238 such that the wing 88' and trim plate 238 pivot and achieve a generally horizontal configuration (as is depicted in FIG. 20). Alternatively, as the motor 44"" decelerates, the motor housing 53"" rotates in a second direction about the motor axis 156"", and the rods 218, 228, 230, 236 and pivot plates 222,232, transfer the motion of the motor housing 53"" to the wing 88' and trim plate 238 such that the wing 88' and trim plate 238 pivot toward a more vertical configuration.

Figure 22:
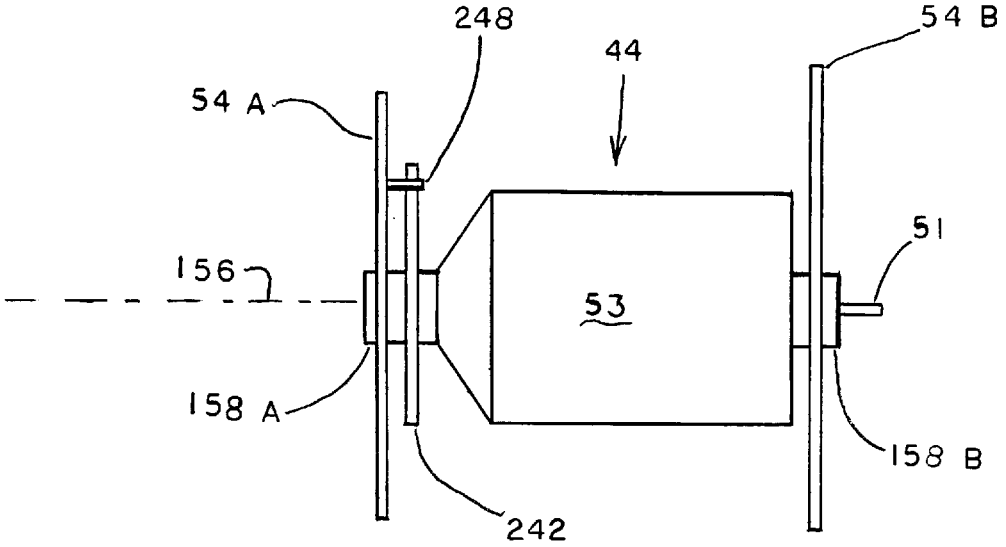
FIG. 22 is schematic, isolated, top view of a motor cooperating with motor mounts and a spring, in accordance with a third alternate embodiment of the present invention.
Figure 23:
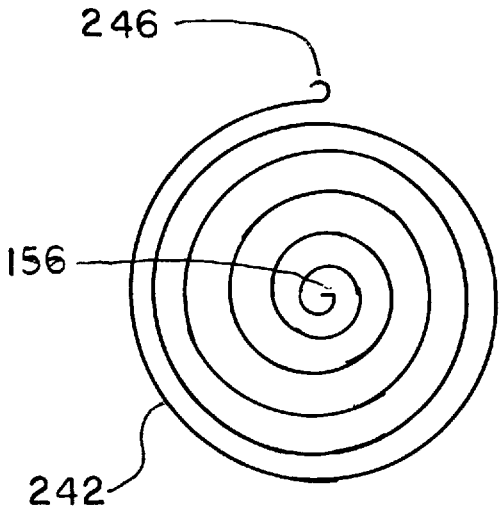
FIG. 23 is an isolated, side elevational view of the spring of FIG. 22, in accordance with the third alternate embodiment of the present invention.

FIG. 22 is schematic, isolated, top view of a motor 44""" cooperating with motor mounts 54""*a,b*, in accordance with a third alternate embodiment of the present invention. In accordance with the third alternate embodiment, the motor 44""" is situated in a vehicle in a manner generally similar to that described above. The motor housing 53""" of the motor 44""" pivots about the motor axis 156""" in a manner similar to that described above, except to a greater degree. A sub-component in the form of a coil spring 242 functions to allow the motor housing 53""" to pivot through a plurality of revolutions about the motor axis 156""" when the motor 44""" accelerates (while the output shaft 51""" also pivots through a plurality of revolutions about the motor axis 156""" and relative to the motor housing 53"""). The coil spring 242 also functions to limit the rotation of the motor housing 53""" as the coil spring 242 becomes compressed. Referring also to FIG. 23, which is an isolated side view of the coil spring 242 in accordance with the third alternate embodiment, the coil spring 242 spirals about the motor axis 156""" and includes an inner end 244 that is connected to the motor housing 53""" proximate to the journal sleeve 158*a*"". The coil spring 242 additionally includes a hooked end 246 that grips a peg 248 extending from the motor mount 54""*a*. The assembly of the third alternate embodiment seeks to smooth out changes in the motive force supplied by the output shaft 51"".

While certain of the preferred and alternate embodiments of the present invention have been disclosed herein, other embodiments of the apparatus and methods of the present invention will suggest themselves to persons skilled in the art in view of this disclosure. Therefore, it will be understood that variations and modifications can be effected within the spirit and scope of the invention and that the scope of the present invention should only be limited by the claims below. Additionally, while it is intended that the scope of the present invention also include various alternate embodiments, it should be understood that each of the embodiments disclosed herein, including the preferred embodiments, include features and characteristics which are considered independently inventive. Accordingly, the disclosure of variations and alterations expressed in alternate embodiments is intended only to reflect on the breadth of the scope of the present invention without suggesting that any of the specific features and characteristics of the preferred embodiment are in any way obvious or unimportant.

I claim:

1. A vehicle including, a frame;

a motor including an exterior housing rotatably mounted to said frame, whereby said exterior housing is capable of rotating relative to said frame, and an output member rotatably mounted to said housing, whereby said output member is capable of rotating relative to said housing and relative to said frame, wherein rotation of said output member imparts motion upon said frame, whereby reactionary forces are created, and wherein said exterior housing is rotatable relative to said frame in response to the reactionary forces, whereby the reactionary forces cause rotation of said housing;

a sub-component movably connected to said frame, wherein said rotation of said housing moves said sub-component relative to said frame and said housing;

linkage interposed between said housing and said sub-component for transmitting motion between said housing and said sub-component;

wherein the frame includes a horizontally extending chassis to which said motor is mounted; and a plurality of wheels connected to the chassis, wherein said sub-component is a suspension member extending laterally from said chassis and including a first end displaced laterally from said chassis, wherein a wheel of the plurality of wheels is rotatably mounted to said first end, and a second end pivotally mounted to said chassis to allow vertical movement of said first end relative to said chassis, and wherein said rotation of said housing moves the first end of the suspension member vertically.

2. The vehicle of claim 1, wherein said rotation of said output member drives the wheel of the plurality of wheels that is rotatably mounted to the first end of the suspension member.

3. The vehicle of claim 2, wherein said motor is an electric motor.

4. The vehicle of claim 1, wherein said linkage and said suspension member interact with said housing to limit said rotation of said housing.

5. The vehicle of claim 1, wherein said linkage includes, at least, a traction bar.

6. A vehicle including, a frame;

a motor including an exterior housing rotatably mounted to said frame, whereby said exterior housing is capable of rotating relative to said frame, and an output member rotatably mounted to said housing, whereby said output member is capable of rotating relative to said housing and relative to said frame, wherein rotation of said output member imparts motion upon said frame, whereby reactionary forces are created, and wherein said exterior housing is rotatable relative to said frame in response to the reactionary forces, whereby the reactionary forces cause rotation of said housing;

a sub-component movably connected to said frame, wherein said rotation of said housing moves said sub-component relative to said frame and said housing; and linkage, said linkage being interposed between said housing and said sub-component for transmitting motion between said housing and said sub-component; and wherein said sub-component is an air spoiler that is pivotally connected to said frame, whereby rotation of said housing causes said air spoiler to pivot relative to the frame.

7. The vehicle of claim 6, wherein said motor is an electric motor.

* * * * *